United States Patent [19]

Ishikawa et al.

[11] Patent Number: 4,873,940

[45] Date of Patent: Oct. 17, 1989

[54] IMAGE DEVELOPING DEVICE

[75] Inventors: Toyoji Ishikawa, Kanagawa; Toshio Kaneko; Shuichi Endo, both of Tokyo; Yoshihiro Ogata; Toshihiko Takaya, both of Kanagawa, all of Japan

[73] Assignee: Ricoh Company, Ltd., Tokyo, Japan

[21] Appl. No.: 922,357

[22] Filed: Oct. 23, 1986

[30] Foreign Application Priority Data

Oct. 23, 1985 [JP] Japan ..... 60-0236979
Feb. 20, 1986 [JP] Japan ..... 61-023485[U]

[51] Int. Cl.[4] ..... G03G 15/08

[52] U.S. Cl. ..... 118/651; 118/653; 355/245; 355/251

[58] Field of Search ..... 118/653, 651, 647; 430/120; 355/3 DD, 14 D

[56] References Cited

U.S. PATENT DOCUMENTS

| | | | |
|---|---|---|---|
| 3,965,862 | 6/1976 | Yang et al. | 118/651 |
| 4,036,175 | 7/1977 | Phillips et al. | 118/651 |
| 4,100,884 | 7/1978 | Mochizuki et al. | 118/653 |
| 4,230,070 | 10/1980 | Murasaki et al. | 118/658 |
| 4,370,049 | 1/1983 | Kuge et al. | 118/651 X |
| 4,378,158 | 3/1983 | Kanbe | 118/647 X |
| 4,382,420 | 5/1983 | Ohnuma et al. | 118/651 |
| 4,469,435 | 9/1984 | Nosaki et al. | 355/3 DD X |
| 4,505,573 | 3/1985 | Brewington et al. | 118/653 X |
| 4,508,052 | 4/1985 | Kohyama | 118/651 |
| 4,625,676 | 12/1986 | Sakamoto et al. | 118/657 |
| 4,641,602 | 2/1987 | Kasai | 118/653 |
| 4,656,964 | 4/1987 | Kanno et al. | 118/651 |
| 4,696,255 | 9/1987 | Yano et al. | 118/653 |

FOREIGN PATENT DOCUMENTS

| | | | |
|---|---|---|---|
| 60126667 | 3/1980 | Japan . | |
| 59126567 | 10/1982 | Japan . | |
| 0185052 | 11/1982 | Japan | 118/653 |
| 0103373 | 6/1985 | Japan | 355/3 DD |
| 0114891 | 6/1985 | Japan | 355/3 DD |
| 58223158 | 4/1986 | Japan . | |
| 2163371 | 2/1986 | United Kingdom | 355/3 DD |

*Primary Examiner*—Shrive Beck
*Assistant Examiner*—Alain Bashore
*Attorney, Agent, or Firm*—Oblon, Spivak, McClelland, Maier & Neustadt

[57] ABSTRACT

An image developing device for use in an electrophotographic copying apparatus or a printer includes a developing roller for supplying toner to a latent image formed on a latent image carrier to develop the latent image into a visible toner image. The image developing device also includes a toner supply roller independently rotatable in abutting engagement with the developing roller for supplying the toner onto the developing roller. Each of the toner supply roller and the developing roller is electrically conductive. An electric potential with its polarity dependent on whether the toner is positively or negatively chargeable is applied between the toner supply toner and the developing roller by a bias voltage distributing circuit.

16 Claims, 12 Drawing Sheets

(TONER SUPPLY CAPABILITY)

(RESIDUAL IMAGE)

(BACKGROUND CONTAMINATION)

(TONER SUPPLY CAPABILITY)

(RESIDUAL IMAGE)

(BACKGROUND CONTAMINATION)

IMAGE DEVELOPING DEVICE

BACKGROUND OF THE INVENTION

1. Field of the Invention

The present invention relates to an image developing device for use in an electrophotographic apparatus or the like.

2. Description of the Prior Art

Some conventional image developing devices for use in electrophotography include a developing roller for transferring a thin layer of toner to a latent image carrier and a toner supply roller held against the developing roller and rotatable independently thereof. The toner supply roller is usually made of a high-resistance resilient material such as sponge (having a volume resistance of $10^{10}$ ohms/cm or more). However, the toner supply roller made of such a material fails to scrape residual toner efficiently off the circumferential surface of the developing toner. If the toner supply roller were unduly pressed against the developing roller or rotated at an increased speed for higher toner scraping capability, the torque required to drive the toner supply roller would be increased or a residual image would be produced.

To avoid the aforesaid problem, it has been customary to apply predetermined bias voltages to the respective rollers used for developing images. Since, however, different bias voltages are required to be impressed on the corresponding rollers, separate circuits have heretofore been needed in the image developing device for applying the respective bias voltages to the rollers. The separate circuits in turn require a plurality of power supply circuits. This prior circuit arrangement is costly and requires a large installation space, with the result that the image developing device becomes inevitably large in size. Inasmuch as the bias voltages to be applied to the rollers are fixed for the toner being used, they cannot be changed to other voltages selected to best match a toner of a different color that is desired to be used in place of the existing toner.

SUMMARY OF THE INVENTION

It is an object of the present invention to provide an image developing device capable of controlling the extent to which toner on a developing roller is charged and the amount of the toner on the developing roller for obtaining a sufficient image density and producing images of stable quality with reduced background contamination and residual images.

To achieve the above object, a toner supply roller held against a developing roller and rotatable independently thereof is electrically conductive. Where toner used is chargeable to a positive potential, the voltage VB applied to the developing roller is lower than the voltage VR applied to the toner supply roller ($VB<VR$). Where the toner used is chargeable to a negative potential, the voltage VB is higher than the voltage VR ($VB>VR$). By thus selecting the applied voltages and their polarities according to the charging characteristics of the toner used, the image developing performance can be increased, the ability to supply the toner to the developing roller can be improved, the density of developed images can be increased because of an increased amount of charged toner in a thin layer which contributes to image development, the generation of residual images is suppressed, and background contamination is reduced.

Another object of the present invention is to provide an image developing device including a simple arrangement capable of supplying bias voltages to be applied to various rollers involved in image development and of varying the bias voltages as required.

To accomplish the above object, a full bias voltage applied from one axial end of one of the various rollers is divided and supplied to the other rollers by a bias voltage distributing means disposed on the image developing device.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
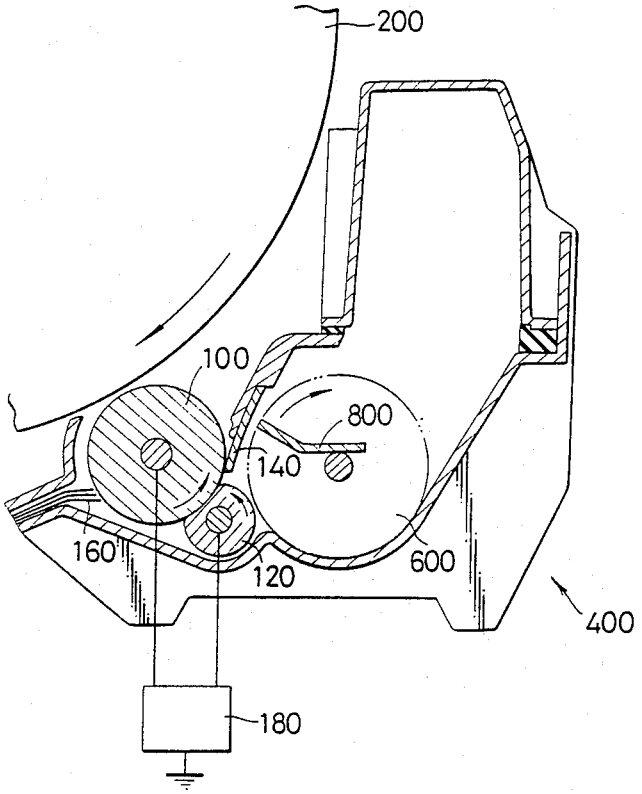
FIG. 1 is a cross-sectional view of an image developing device according to the present invention.

As shown in FIG. 1, a latent image carrier 200 comprising a photosensitive drum, for example, is rotatable clockwise about its own axis. As the photosensitive drum 200 with an electrostatic latent image carried thereon moves past an image developing device 400, the latent image is developed by the image developing device 400 into a visible toner image.

The image developing device 400 generally comprises a toner hopper 600, an agitator 800 rotatable in the direction of the arrow, an image developing roller 100 rotatable counterclockwise and disposed closely to the photosensitive drum 200 in confronting relation, and a toner supply roller 120 held against the developing roller 100 and rotatable counterclockwise about its own axis. An eraser brush 160 for removing electric charges is held against the peripheral surface of the toner supply roller 120. A doctor blade 140 for regulating the thickness of a thin toner layer is also held against the peripheral surface of the toner supply roller 120.

Figure 2:
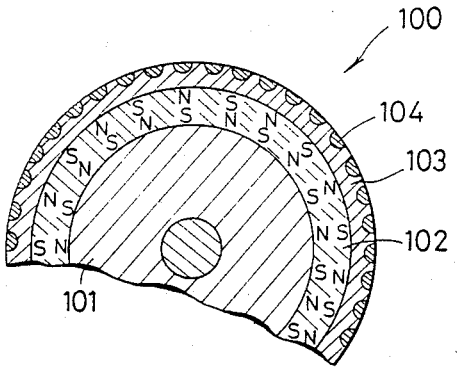
FIG. 2 is a fragmentary cross-sectional view of a developing roller.

As illustrated in FIG. 2, the developing roller 100 comprises a core member 101, a magnetic rubber layer 102 disposed around the core member 101 and magnetized alternately in N and S poles, and floating electrodes 104 arranged in a stripe pattern around the magnetic rubber layer 102 with an adhesive layer 103 therebetween, each of the floating electrodes 104 being made of copper particles or epoxy resin with carbon particles dispersed therein.

The toner supply roller 120 is made of an electrically conductive resilient material such as a resilient foamed product impregnated with an electrically conductive carbon such as ketjen black, or a suitable matrix in which such electrically conductive carbon is dispersed.

A power supply is connected between the developing roller 100 and the toner supply roller 120. The voltages applied to these rollers are selected as follows dependent on the charging characteristics of toner used:

Where the toner used is chargeable to a positive potential, $VB<VR$ (where VB is the voltage applied to the developing roller 100 and VR is the voltage applied to the toner supply roller 120), and where the toner used is chargeable to a negative potential, $VB>VR$.

The image developing device thus constructed will operate as follows:

One-component toner (magnetic or nonmagnetic toner) stored in the toner hopper 600 is transferred by the agitator 800 onto the toner supply roller 120, from which the toner is transferred by rotation of the toner supply roller 120 to the developing roller 100. The toner is now electrically charged by frictional engagement with the peripheral surface of the developing toner 100, and attracted to the floating electrodes 104.

The toner attracted to the floating electrodes 104 rotates with the developing roller 100, and is regulated into a layer by the doctor blade 140. The toner particles are triboelectrically charged between the developing roller 100 and the doctor blade 140 and fed to an image developing area close to the photosensitive drum 200 while being attracted to the floating electrodes 104.

The toner layer that has reached the image developing area is partly removed from the developing roller 100 by being attached to an electrostatic latent image carried on the photosensitive drum 200. The remaining toner layer remains attached to the developing roller 100, and the electric charges are removed from the remaining toner layer by the eraser brush 160, after which the remaining toner layer returns to the toner supply roller 160. The brush 160 is capable of removing counter-charges which are produced on the developing roller 100 upon image development with the charged toner attached to the floating electrodes 104.

The toner on the floating electrodes 104 that has returned to the toner supply roller 120 is scraped off the developing roller 100 by the toner supply roller 120 which is rotating in the direction opposite to the direction of rotation of the developing roller 100. As a result, the peripheral surface of the developing roller 100 is restored to the initial condition.

Then, new toner is triboelectrically attracted to the floating electrodes 104 through frictional engagement between the developing roller 100 and the toner supply roller 120, and fed to the image developing area. The aforesaid cycle is repeated to develop electrostatic latent images on the photosensitive drum 200.

Various image developing characteristics were checked with respect to toners that are chargeable to positive and negative potentials by changing the voltage VB applied to the developing roller 100 and the voltage VR applied to the toner supply roller 120 by varying the polarities and voltages of the power supply 180.

Figure 3:
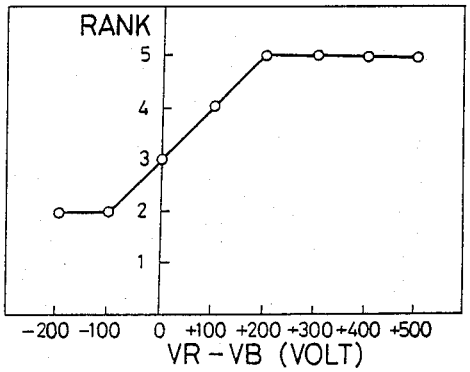
FIGS. 3 through 8 are graphs showing the image developing characteristics of the image developing device of the invention.

1. When the positively chargeable toner is used:

(a) The toner supply capability was estimated by way of image density, and evaluated in ranks 1 through 5 as shown in FIG. 3. FIG. 3 shows that the toner supply capability is good when $VB<VR$.

Figure 4:
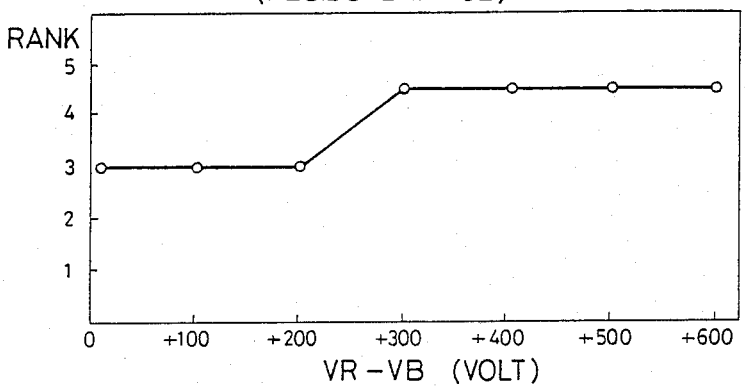

(b) Immediately after an image has been developed, an image pattern corresponding to the electrostatic latent image on the photosensitive drum is formed on the developing roller. This image pattern tends to be transferred as a residual image onto the photosensitive drum in a next development cycle. The formation of such a residual image was evaluated in ranks 1 through 5 as shown in FIG. 4. FIG. 4 indicates that a residual image is less likely to be formed when $VB<VR$.

Figure 5:
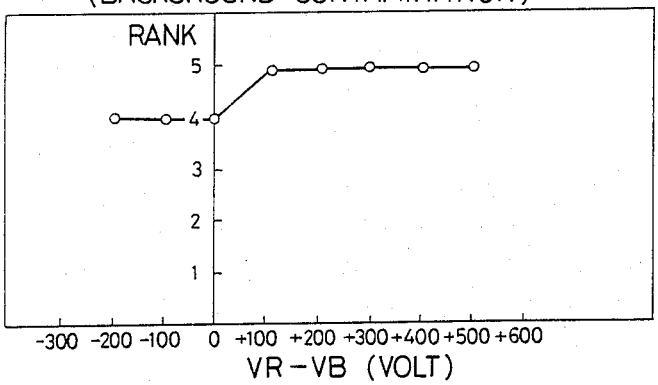

(c) Upon image development, toner may be attached to the background of an image such as letters or the like, causing background contamination. The extent of such background contamination was evaluated in ranks 1 through 5 as shown in FIG. 5. FIG. 5 shows that the background contamination is less apt to be produced when $VB<VR$.

Figure 6:
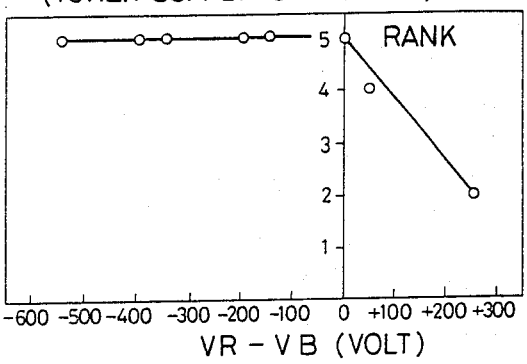
Figure 7:
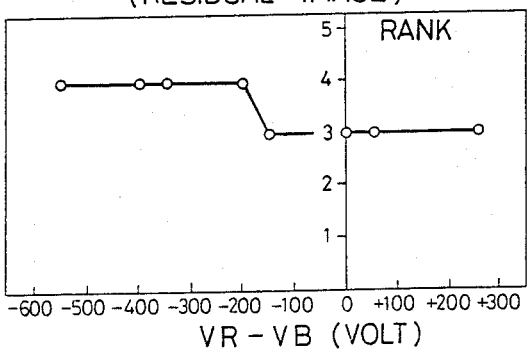
Figure 8:
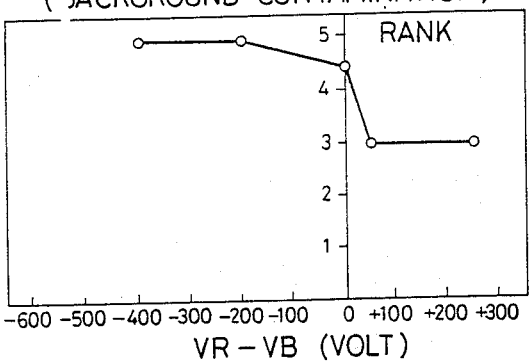

2. When the negatively chargeable toner is used:

The toner supply capability (FIG. 6), the residual image (FIG. 7), and the background contamination (FIG. 8) were checked in the same manner as when the positively chargeable toner was used. FIGS. 6 through 8 indicate that good results are obtained when $VB>VR$.

Therefore, the image developing performance can be increased by selecting the voltages to be applied and the polarities of the voltages according to the charging characteristics of the toner used.

Figure 9:
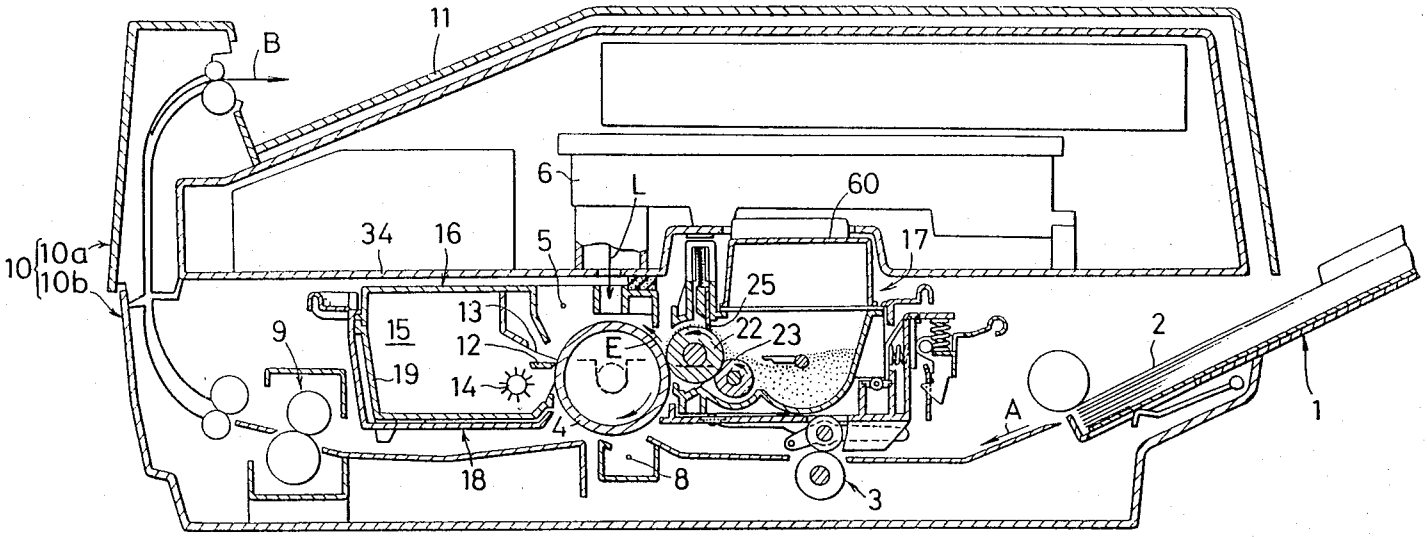
FIG. 9 is a vertical cross-sectional view of an image forming device according to an embodiment of the present invention.

FIG. 9 shows a laser printer as one example of an image forming device. A sheet 2 of image recording paper fed from a sheet feeder 1 in the direction of the arrow is delivered to a latent image carrier 4 comprising a photosensitive drum after being properly timed by a resist roller pair 3 to rotation of the photosensitive drum 4.

The photosensitive drum 4 is driven to rotate clockwise about its own axis. After its peripheral surface has been charged by a charger 5, the photosensitive drum 4 is exposed to a laser beam L emitted from a laser beam optical system 6 to form an electrostatic latent image on the drum 4. An image developing device 17 has a developing roller 22 which rotates in contact with the photosensitive drum 4. Toner is supplied by the developing roller 22 to the photosensitive drum 4. The electrostatic latent image on the photosensitive drum 4 is developed by the supplied toner into a visible image, which is transferred by an image transfer charger 8 onto the sheet 2 that has been fed to a position underneath the photosensitive drum 4. The visible toner image transferred onto the sheet 2 is thereafter fixed thereto by an image fixing device 9. The sheet 2 which has left the image fixing device 9 is discharged as indicated by the arrow B onto a sheet receiver 11 on an upper wall of a printer body or housing 10.

After the visible image has been transferred from the photosensitive drum 4 onto the sheet 2, toner remaining on the drum 4 is scraped off the drum 4 by a cleaning device having a cleaning blade 12, and electric charges are removed by the scraped toner by an eraser 13. The toner that has been removed from the photosensitive drum 4 is collected by a blade wheel 14 into a toner storage chamber 15, and stored therein.

Figure 10:
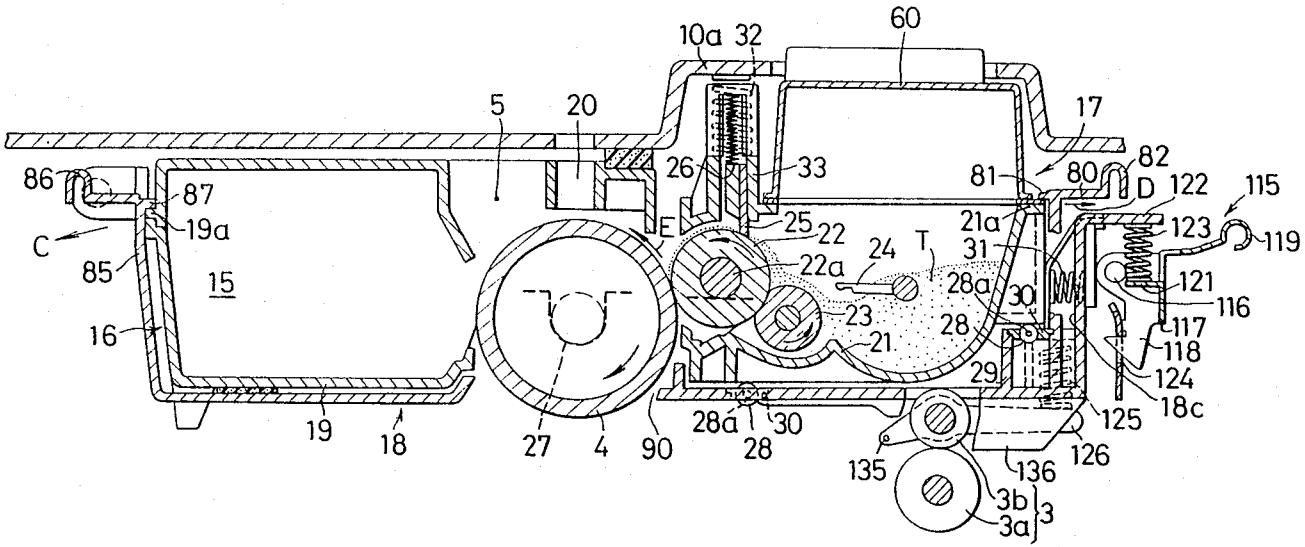
FIG. 10 is an enlarged cross-sectional view of a portion of FIG. 9.

As shown in FIG. 10, the photosensitive drum 4 and its related components are arranged as a single image carrier unit 16. The image carrier unit 16 and the image developing device 17 having the developing roller 22 and the other parts are separately detachably mounted in an image forming unit case 18 in the form of an upwardly open box which is mounted in the printer body 10.

Toner T is stored in a case 21 of the image developing device 17. The developing roller 22 disposed in confronting relation to the photosensitive drum 4, a toner supply roller 23 for supplying toner to the developing roller 22, and an agitator 24 for agitating and delivering the toner to the toner supply roller 23 are disposed in the case 21. A doctor blade 25 for regulating the thickness of a toner layer is pressed against the upper portion of the developing roller 22 under the resiliency of a spring 26. The developing roller 22 has a support shaft **22*a* rotatably supported by the case 21. The toner supply roller 23 and the agitator 24 are also rotatably supported in the case 21. The doctor blade 25 is also mounted on the base 21**.

During image development, the toner T in the case 21 is supplied by the toner supply roller 23 as it rotates to the developing roller 22. The toner supplied to the developing roller 22 which rotates counterclockwise is regulated into a thin layer by the doctor blade 25, and fed into an area in which the photosensitive drum 4 and the developing roller 22 confront each other. Then, the toner is transferred electrostatically onto the latent image on the photosensitive drum 4.

Figure 11:
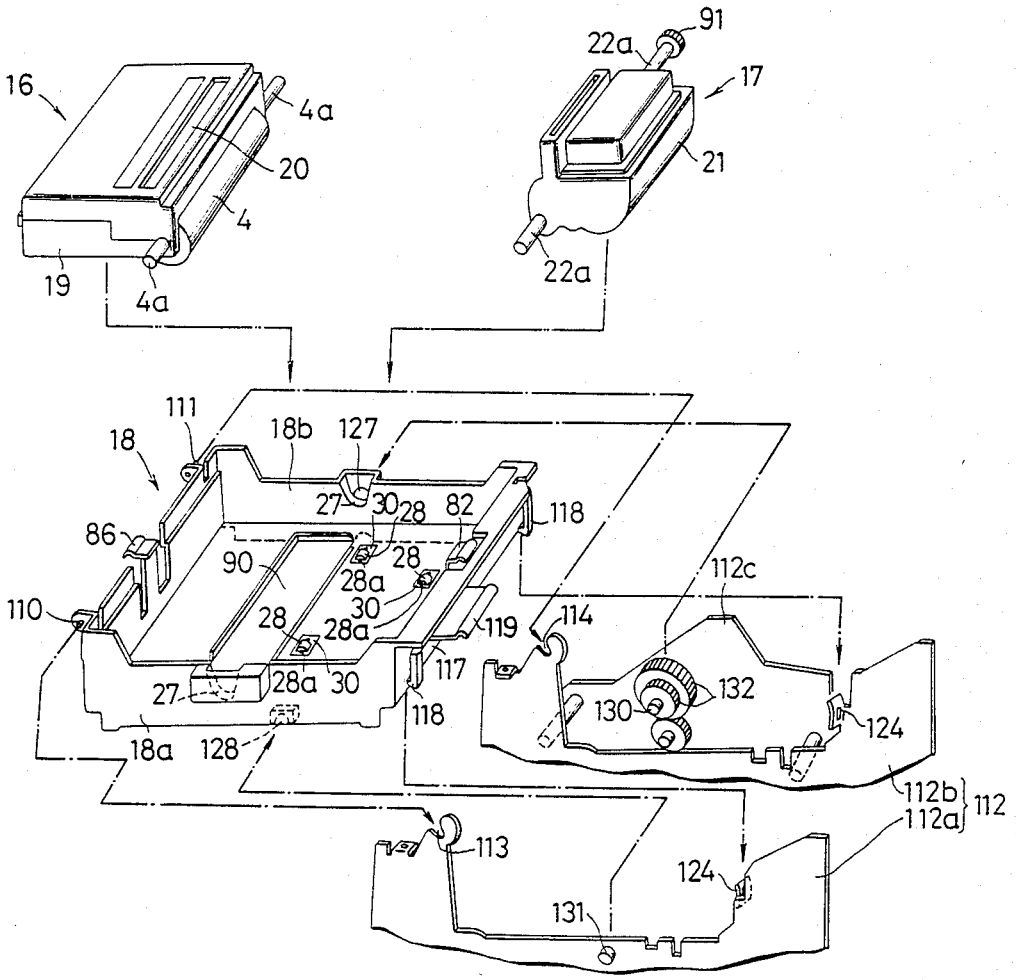
FIG. 11 is an exploded perspective view of an image forming unit.

As illustrated in FIGS. 9 through 11, the image carrier unit 16 has a box-like case 19 by which the support shaft **4*a* of the photosensitive drum 4 is rotatably supported. The case 19 has a slot 20 through which the laser beam L from the laser beam optical system 6 is applied to the photosensitive drum 4. The case 19 defines the toner storage chamber 15 therein. The charger 5 (FIGS. 9 and 10), the eraser 13 (FIG. 9), the blade wheel 14, and the cleaning blade 12 are supported in the case 19, and constitute the image carrier unit 16**.

Figure 12:
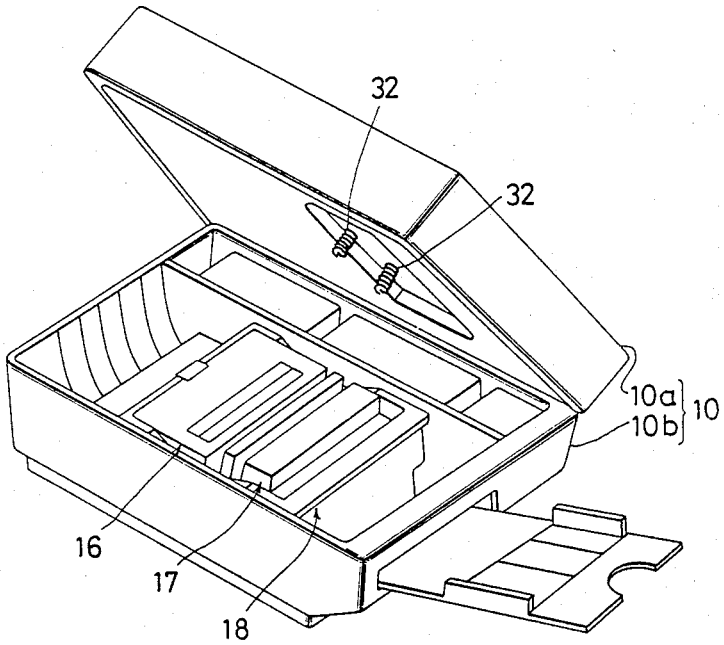
FIGS. 12 and 13 are perspective views of the image forming device, with an upper portion thereof opened.

As shown in FIG. 12, the printer body or housing 10 comprises an upper portion **10*a* and a lower portion 10*b* which are interconnected by a hinge (not shown) on sides thereof so that the upper portion 10*a* can be angularly moved to close and open the lower portion 10*b*. The image forming unit case 18 is disposed in the lower housing portion 10*b*, and hence so are the image carrier unit 16 and the image developing device 17. As a result, when the upper housing portion 10*a* is opened, as shown in FIG. 12, the upper portions of the image carrier unit 16 and the image developing device 17 are exposed to view. As described later on, the image forming unit case 18 is supported on the lower housing portion 10*b* for vertical angular movement (FIG. 13), and can be locked in the lower housing portion 10*b*** by a lock device (described later).

Figure 14:
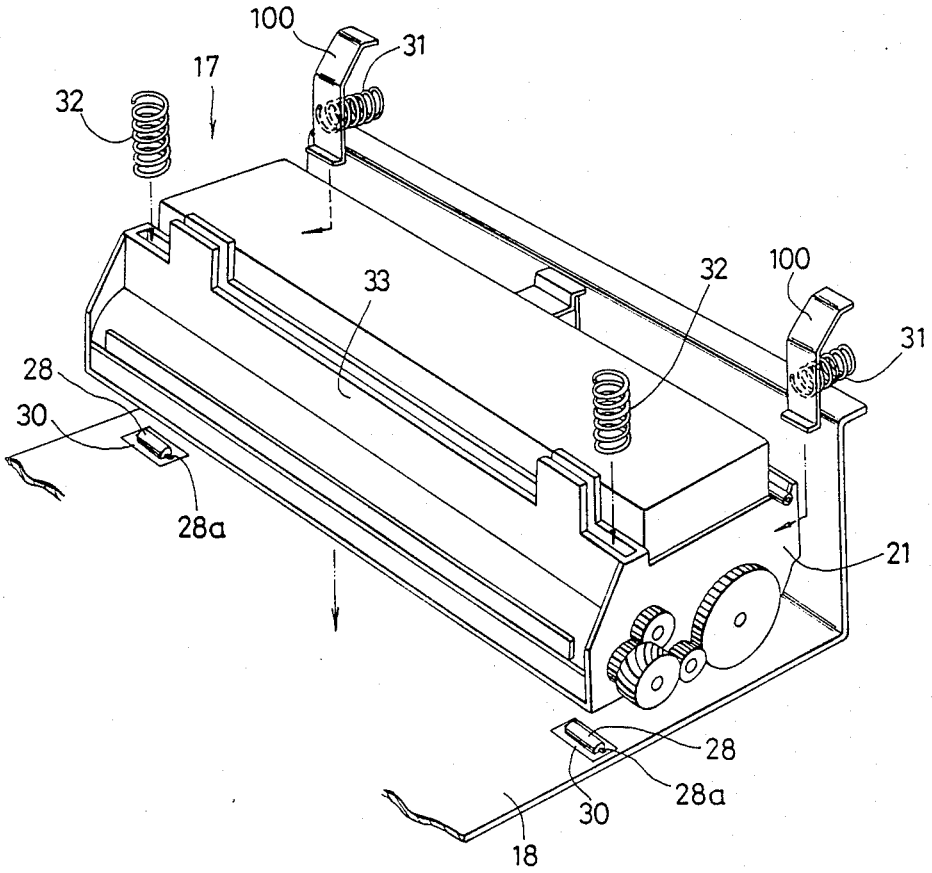
FIG. 14 is a perspective view of an image developing device mounted in position.
Figure 15:
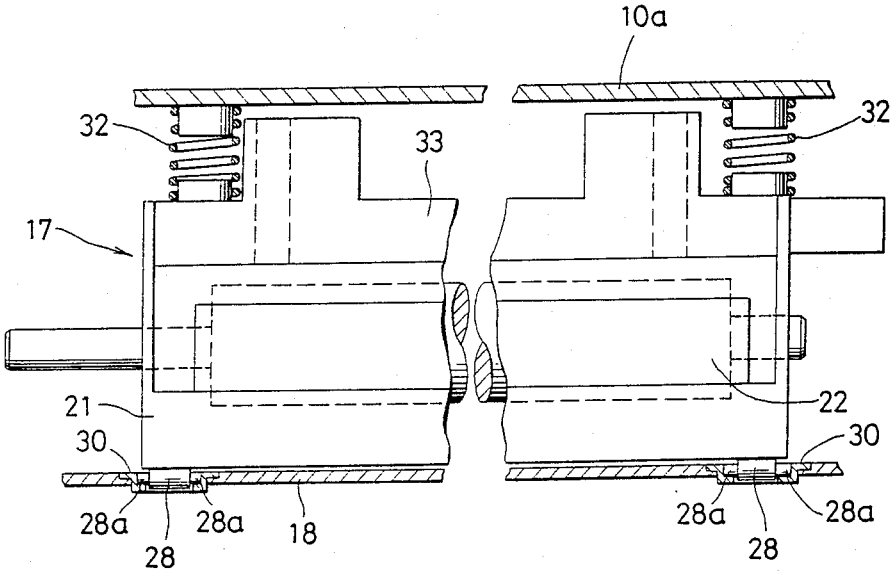
FIG. 15 is a front elevational view of the image developing device.

As illustrated in FIGS. 11, 14 and 15, the case 21 of the image developing device 17 is placed on three rollers 28 rotatably mounted on the bottom wall of the image forming unit case 18. Two of these three rollers 28 are positioned in spaced relation on a front edge portion (lefthand side in FIG. 10) of the bottom wall of the image forming unit case 18, while the other roller 28 is positioned on a support base 29 on a rear edge portion (righthand side in FIG. 10) of the bottom wall of the image forming unit case 18. The rollers 28 are rotatably mounted in respective bearing cases 30 fitted in the bottom wall of the image forming unit case 18 and the support base 29. Each of the rollers 28 has a shaft **28*a* extending transversely of the laser printer, i.e., substantially parallel to the developing roller 22. The shafts 28*a* are supported on edges of the bearing cases 30. Therefore, the image developing device 17 can move smoothly back and forth, i.e., to the right and left in FIG. 10**, without being subjected to any appreciable frictional resistance.

The image developing device 17 is normally urged in a direction to move from its rear end, i.e., the righthand end in FIG. 10, toward the image carrier unit 16 under the resilient forces of coil springs 31 acting between vertical side walls of the case 21 and the case 18, so that the developing roller 22 is pressed into contact with the photosensitive drum 4 by the coil springs 31. Therefore, the pressure under which the developing roller 22 is pressed against the photosensitive drum 4 can be adjusted to an appropriate level by selecting the spring constants of the coil springs 31.

The upper housing portion **10*a* of the printer housing 10 has two spring seats on its lower surface. Two coil springs 32 are mounted on the respective spring seats and project toward the image developing device 17. When the upper housing portion 10*a* is closed over the lower housing portion 10*b*, as shown in FIG. 10, the distal ends of the coil springs 32 are pressed against the image developing device 17 to push the image developing device 17 downwardly. In the illustrated embodiment, the coil springs 32 are held in contact with the upper end surface of a blade housing 33 in which the doctor blade 25 is housed. The image developing device 17 is pressed against the rollers 28 under the downward forces of the coil springs 32 to keep the developing roller 22 retained against the photosensitive drum 4 without being lifted off the drum 4**.

Since the coil springs 32 can be flexed laterally (in the horizontal direction of FIG. 10), they do not interfere with the back-and-forth movement of the image developing device 17 on the rollers 28.

The developing roller 22 is therefore normally held in contact with the photosensitive drum 4 under proper pressure by the coil springs 31, 32 for developing an image on the drum 4 effectively.

Figure 16:
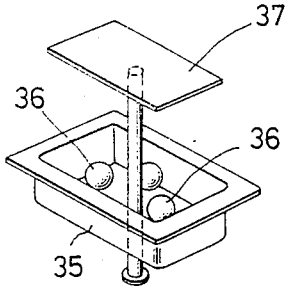
FIG. 16 is an exploded perspective view of an image developing device support member according to another embodiment.

Instead of the rollers 28, the image developing device 17 may be placed on a support member as shown in FIG. 16. A case 35 in the form of an upwardly open box is placed in a hole defined in the bottom of the image forming unit case 18, with a plurality of steel balls 36 being freely movably put in the case 35. The image developing device 17 is then placed on a support plate 37 positioned on the steel balls 36 in rolling contact therewith. Alternatively, such an image developing device support member may comprise ball bearings or sliding members of a polymeric material.

Figure 17:
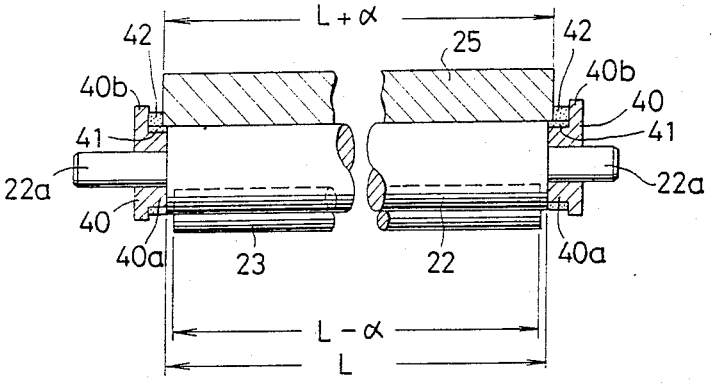
FIGS. 17 and 18 are cross-sectional views of a toner sealing device for a developing roller.

As shown in FIG. 17, the developing roller 22 has a length L and the toner supply roller 23 has a length $(L-\alpha)$ which is slightly smaller than the length L of the developing roller 22. The doctor blade 25 has a length $(L+\alpha)$ which is slightly larger than the length L of the developing roller 22. With this arrangement, the toner can be supplied from the shortest toner supply roller 23 to the developing roller 22 without overflowing the opposite ends of the developing roller 22, and the toner remaining on the developing roller 22 can completely be scraped off by the toner blade 25 that is wider than the developing roller 22.

Figure 18:
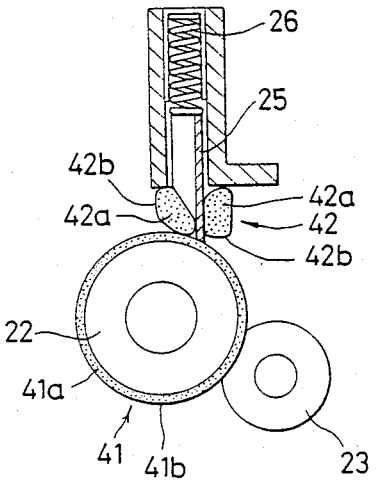

The developing roller 22 has a shaft 22*a* with its opposite ends supported by respective bearings 40 with their inner end surfaces disposed closely to the outer opposite ends of the developing roller 22. The bearings 40 have bodies 40*a* wrapped by sealing members 41, respectively, which seal the toner against leakage through the developing roller 22. As illustrated in FIG. 18, each of the sealing members 41 comprises a urethane foam layer 41*a* directly wound around the body 40*a* and a Mylar film 41*b* wound around the urethane foam layer 41*a*, and is intimately held against one of the outer opposite ends of the developing roller 22. The sealing members 41 are retained in place on the bodies 40*a* by flanges 40*b* on the outer ends thereof, respectively, against displacement off the bearings 40.

Sealing members 42 are disposed at the opposite ends of the doctor blade 25 upwardly of the sealing members 41, respectively, for sealing any toner leakage from the doctor blade 25. The sealing members 42 are pressed against the doctor blade 25 by the flanges 40*b* of the bearings 40 and arranged in partly wrapping corners at the opposite ends of the doctor blade 25. Each of the sealing members 42 comprises a urethane foam layer 42*a* and a Mylar film 42*b* wound around the urethane foam layer 42*a*.

The toner sealing structure of the above arrangement is simple and capable of reliably sealing toner between the developing roller 22, the bearings 40, and the doctor blade 25.

Figure 19:
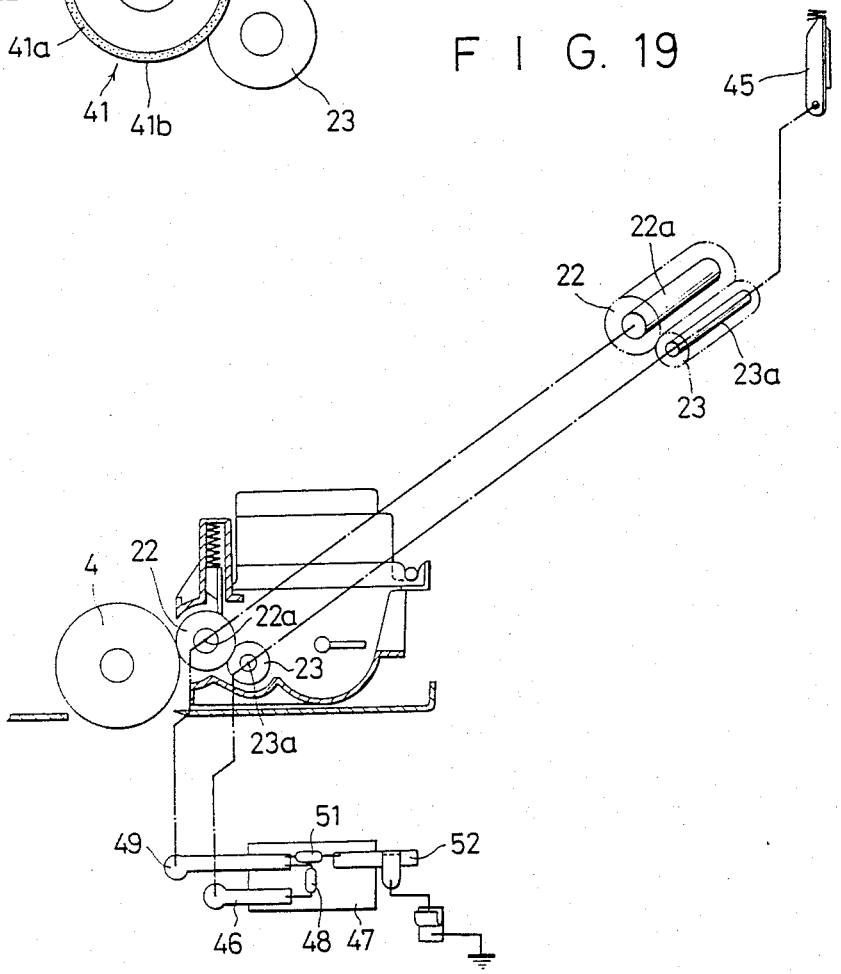
FIG. 19 is a schematic view showing a bias voltage applying means.

As shown in FIG. 19, the toner supply roller 23 has a shaft 23*a* with one end thereof being electrically connected to a main input terminal 45 on the laser printer body for applying a full bias voltage. The other end of the shaft 23*a* is electrically connected to a supply bias terminal 46 to which an input voltage from the main input terminal 45 is applied. The supply bias terminal 46 is fixed to an insulating baseboard 47 attached to the case 21 of the image developing device 17 for applying the bias voltage to a bias voltage distributing circuit on the insulating baseboard 47.

The bias voltage distributing circuit on the insulating baseboard 47 includes a developing bias terminal 49 electrically connected via a thick-film resistor 48 to the supply bias terminal 46 and a ground terminal 52 electrically connected via a thick-film resistor 51 to the developing bias terminal 49. The distal ends of the developing bias terminal 49 and the ground terminal 52 are electrically coupled to the support shaft 22*a* of the developing roller 22 and ground, respectively. Therefore, a toner developing bias voltage corresponding to the electric resistance of the thick-film resistor 51 is applied to the developing roller 22, whereas a toner supply bias voltage corresponding to the electric resistance of the thick-film resistor 48 is applied to the toner supply roller 23.

By thus applying the full bias voltage from the shaft end 23*a* of the toner supply roller 23 and dividing the applied full bias voltage on the insulating baseboard 47 fixed to the image developing device 17, into the toner supply bias voltage to be applied to the toner supply roller 23 and the toner developing bias voltage to be applied to the developing roller 22, the desired bias voltages can freely be selected simply by changing the insulating baseboard 47 to alter the bias voltage distributing circuit thereon.

Other components that are required to be electrically biased, such as an eraser roller, may also be supplied with divided bias voltages produced by a circuit arrangement similar to the above arrangement.

Figure 20:
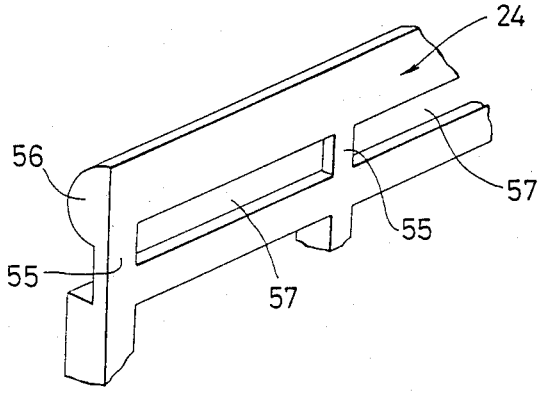
FIG. 20 is an enlarged fragmentary perspective view showing the configuration of a tip end of an agitator.

As shown in FIG. 20, the agitator 24 has an arm including in its distal end portion a thin hinge 55 supporting on its tip end a thicker portion 56 having a semicircular cross section. The hinge 55 has a plurality of slots 57 defined therethrough so as to make the hinge 55 flexible to a certain extent.

When the agitator 24 of the above configuration is molded, a molten material can flow easily into the tip end of the agitator 24 because of the thicker portion 56 on the distal end thereof. Therefore, the agitator 24 as a whole, particularly the distal end thereof, can easily be formed with its shape finished highly accurately. The extent to which the distal end of the agitator 24 is flexible can freely be selected by adjusting the thickness of the hinge 55 and configuration, the size, and the number of the slots 57.

The thicker portion 56 of the agitator 24, is capable of feeding the toner efficiently since the toner is carried in a large quantity by the thicker portion 56. As the thicker portion 56 is made appropriately flexible by the thinner hinge 55, it can be sufficiently held in intimate contact with the inner wall surface of the case 21 of the image developing device 17 for scraping toner well off the inner wall surface of the case 21.

Figure 21:
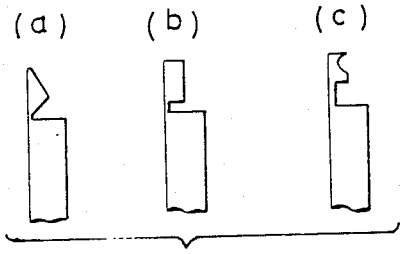
FIGS. 21(*a*), 21(*b*), and 21(*c*) are fragmentary side elevational views of tip ends of agitators according to other embodiments.

The thicker portion 56 may be of a triangular cross section as shown in FIG. 21(*a*), or a rectangular cross section as shown in FIG. 21(*b*), or a grooved cross section as shown in FIG. 21(*c*).

As shown in FIGS. 9 and 10, the upper opening of the case 21 is covered by a detachable toner cartridge 60. When the case 21 is running short of toner, the toner cartridge 60 is replaced with a new toner cartridge to supply toner to the case 21.

Figure 22:
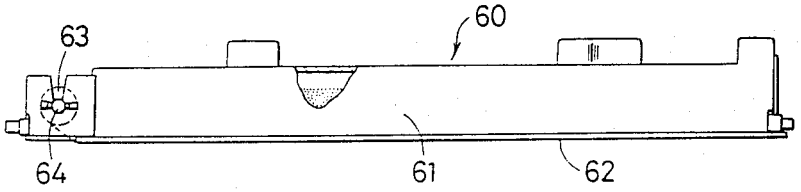
FIGS. 22 and 23 are side elevational and plan views of a cartridge.
Figure 23:
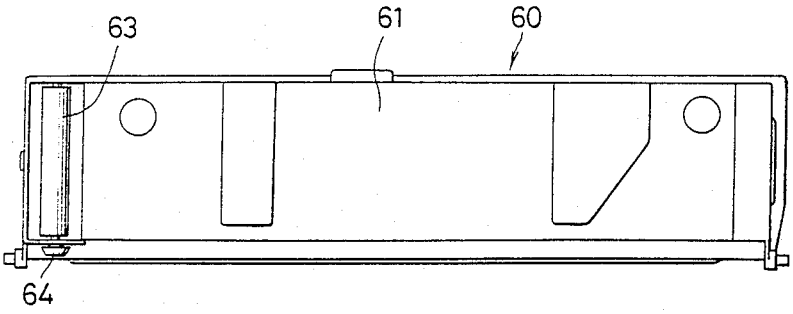

As illustrated in FIGS. 22 and 23, the toner cartridge 60 has a container 61 in the form of an elongate tray containing toner therein and having a bottom opening which is closed by a peelable film-like sealing member 62 bonded to the surrounding edge of the bottom opening. The sealing member 62 has one end bent over around one end of the container 61 toward the other end thereof, and the tip of the bent end is wound around a takeup roller 63. The takeup roller 63 is rotatably supported on the end of the container 61. The sealing member 62 can be peeled off the container 61 by rotating the takeup roller 63 to wind up the sealing member 62.

Figure 24:
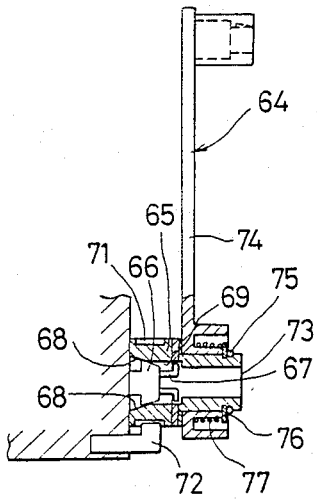
FIGS. 24 and 25 are cross-sectional and front elevational views of a member for winding a cartridge seal.
Figure 25:
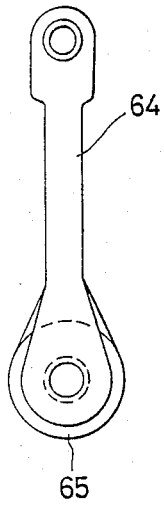

The takeup roller 63 has one end projecting out of the container 61 and serving as a lever coupling. As shown in FIGS. 24 and 25, a boss 65 of a takeup lever 64 is detachably mounted on the lever coupling of the takeup roller 63. More specifically, the lever coupling of the takeup roller 63 comprises a rotation transmitting member 66 in the form of a plate extending diametrically in opposite directions, and a retainer 67 projecting axially from the distal end of the rotation transmitting member 66 and composed of two flexible fingers which are flexibly displaceable in the radial direction. The rotation transmitting member 66 has radially outer ends tapered progressively in the axial direction to the distal end thereof. The two flexible fingers of the retainer 67 extend substantially parallel to each other in the axial direction on opposite sides of the central axis of the retainer 67, and have distal ends bent radially outwardly in the form of hooks.

The boss 65 of the takeup lever 64 has a hole to be fitted over the lever coupling of the takeup roller 63. The hole of the boss 65 comprises a first engagement hole 68 for receiving the rotation transmitting member 66 and a second engagement hole 69 for receiving the retainer 67. The first engagement hole 68 has two diametrically opposite grooves defined to accommodate the radially outer ends of the rotation transmitting member 66. With the rotation transmitting member 66 fitted in the grooves of the first engagement hole 68, the rotative power of the takeup lever 64 can be transmitted to the takeup roller 63. The radially outermost wall surfaces of the grooves are tapered substantially complementarily to the tapered outer ends of the rotation transmitting member 66. The takeup lever 64 is positioned in the axial direction through engagement between the tapered wall surfaces of the grooves and the tapered outer ends of the rotation transmitting member 66.

The second engagement hole 69 is of a stepped configuration including a front smaller-diameter portion closer to the first engagement hole 68 and a rear larger-diameter portion remote from the first engagement hole 68. When the retainer 67 is inserted into the second engagement hole 69, the flexible fingers of the retainer 67 are first caused by the smaller-diameter portion to flex resiliently in the radially inward direction, and then spring back into the larger-diameter portion. After the retainer 67 has been inserted in the second engagement hole 69, therefore, the takeup lever 64 is prevented by the retainer 67 from being axially displaced off the rotation transmitting member 66 under normal conditions. When the takeup lever 64 is pulled back axially in a direction away from the rotation transmitting member 66 under a force stronger than a certain level, the two flexible fingers of the retainer 27 are forced to move through the second engagement hole 69 while resiliently flexing radially inwardly. The takeup lever 64 can thus be detached from the takeup roller 63.

The boss 65 of the takeup roller 63 has a plurality of ratchet teeth 71 on its outer circumference which are selectively engageable by a ratchet stopper 72 mounted on the cartridge container 61. The boss 65 can be rotated only in one direction by the ratchet mechanism composed of the ratchet teeth 71 on the boss 65 and the ratchet stopper 72 engageable therewith.

From the boss 65, there projects axially a lever attachment shaft 73 to which a lever 74 is coupled through a ratchet mechanism that is constructed to allow the lever 74 to rotate in a direction opposite to that in which the boss 65 is rotated by the ratchet mechanism 71, 72. Therefore, when the lever 74 idly rotates around the lever attachment shaft 73, the boss 65 is fixed to the container 61. When the lever 74 is rotated in locked engagement with the lever attachment shaft 73, the boss 65 is released and hence rotated in unison with the lever attachment shaft 73 by the lever 74. Thus, the takeup roller 63 can be turned in increments to wind up the sealing member 62 by angularly moving the lever 74 through incremental angles.

The boss 63 and the lever attachment shaft 73 may be integrally formed with each other. The lever 73 is prevented from being axially displaced off the lever attachment shaft 74 by means of spring 77 retained on the lever 73 by a retaining ring 75 and a spacer 76. However, the lever 73 may be retained on the lever attachment shaft 74 by staking or any of other suitable means.

The ratchet mechanism between the boss 65 and the container 61 may be disposed on the axially end surface of the boss 65. The ratchet mechanism may be replaced with suitable means for increasing the resistance to rotation of the takeup roller 63.

The image developing device 17 is locked in the image forming unit case 18 by a second stopper 80 integrally formed with the image forming unit case 18 on the righthand end (FIG. 10) thereof. The second stopper 80 has a stopper finger 81 and a knob 82 and is formed of synthetic resin, for example, so that the second stopper 80 is elastically deformable in the direction of the arrow D. When the image developing device 17 is accommodated in the image forming unit case 18, the stopper finger 81 of the second stopper 80 engages an engagement tongue **21*a* of the case 21 of the image developing device 17 to hold the latter in the case 18. When the image developing device 17 is to be detached from the case 18 for inspection, servicing, or replacement, the upper housing portion 10*a* is opened as shown in FIG. 12 to release the image developing device 17 of the downwardly pressing forces of the coil springs 82, and then the knob 82 is pulled to the right (FIG. 10) to elastically deform the second stopper 80 in the direction of the arrow D. The stopper finger 81 is therefore disengaged from the engagement tongue 21*a*, whereupon the image developing device 17 can be lifted out of the case 18. For placing the image developing device 17 into the case 18, the image developing device 17 is lowered into the case 18 while pushing the second stopper 80 to the right through elastic deformation thereof. Thereafter, the stopper finger 81 is allowed to spring back into engagement with the engagement tongue 21*a*. After the stopper finger 81 has engaged the engagement tongue 21*a*, the second stopper 80 resiliently urges the image developing device 17 to the left in FIG. 10** at all times.

As shown in FIG. 11, the image forming unit case 18 has a pair of laterally spaced walls **18*a*, 18*b* having a pair of support recesses 27, respectively, in which the shaft 4*a* of the photosensitive drum 4 is rotatably supported by bearings (not shown). The image carrier unit 16 is held in the image forming unit case 18 with the shaft 4*a* of the photosensitive drum 4 being supported in the support recesses 27. At this time, the image carrier unit 16 is locked in the image forming unit case 18 by means of a first stopper 85 on the righthand end of the case 18 as shown in FIG. 10. The first stopper 85 is formed of synthetic resin, for example, integrally with the case 18. The first stopper 85 is elastically deformable in the direction of the arrow C. The first stopper 85 has a knob 86 and a stopper finger 87. The first stopper finger 87 engages an engagement tongue 19*a* of the case 19 of the image carrier unit 16 to hold the image carrier unit 16 within the case 18 as shown in FIG. 10. When the image carrier unit 16 is to be repaired, inspected, or replaced, the upper housing portion 10*a* is opened as shown in FIG. 12, and the knob 86 is pulled to the left in FIG. 10** to cause the first stopper 85 to be elastically deformed in the direction of the arrow C until the stopper finger 87 disengages from the engagement tongue 19*a* of the case 19. The image carrier unit 16 can now be lifted upwardly out of the case 18. The shaft 4*a* of the photosensitive drum 4 can smoothly be removed from the support recesses 27 which open upwardly. For loading the image carrier unit 16 into the case 18, the image carrier unit 16 is lowered into the case 18 to allow the shaft 6*a* to fit into the support recesses 27. By lightly pushing the image carrier unit 16 downwardly, the case 19 elastically deforms the first stopper 85 in the direction of the arrow C, and then the stopper finger 87 springs back into engagement with the engagement tongue 19*a* of the image carrier unit 16. In this manner, the image carrier unit 16 can easily be set in the image forming unit case 18.

With the image carrier unit 16 supported in the image forming unit case 18, part of the photosensitive drum 4 is inserted in an opening 90 defined in the bottom of the image forming unit case 19. A gear (not shown) mounted on the shaft 4*a* is also partly inserted in the opening 90 and held in mesh with a gear (not shown) supported in the lower housing portion 10*b* of the laser printer for being driven thereby. Likewise, a gear 91 on the shaft 22*a* of the developing roller 22 and gears (not shown) on the toner supply roller 23 and the agitator 24 are held in mesh with gears in the lower housing portion 10*b* for being driven thereby.

Since the lower housing portion 10*b* and the case 18 are held horizontally, the image carrier unit 16 and the image developing device 17 can be taken vertically into and out of the case 18 by the operator who is taking a normal standing posture.

Figure 26:
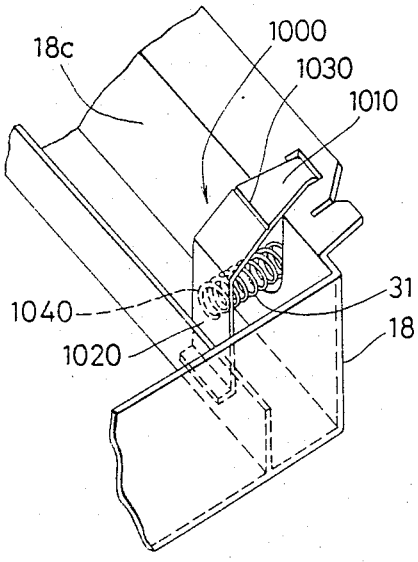
FIG. 26 is an enlarged fragmentary perspective view of a means including a presser for urging the image developing device in contact therewith.

As described above, the two coil springs 31 are disposed between a wall 18*c* (on the righthand end FIG. 10) of the image forming unit case 18 and the rear end (on the righthand end in FIG. 10) of the case 21 of the image developing device 17 for normally urging the entire image developing device 17 forwardly (to the left in FIG. 10). As shown in FIG. 26, each of the coil springs 31 presses the image developing device 17 through a hinged presser 1000 extending downwardly from the upper end of the righthand wall 18*c* of the case 18.

The hinged presser 1000 is formed of synthetic resin and includes a base plate portion 1010 extending substantially horizontally from the upper end of the wall 18*c* and a swing plate portion 1020 extending downwardly from the inner end of the base plate portion 1010 through a bent portion and held against the rear end of the image developing device 17.

The base plate portion 1010 has a hook for fitting engagement in a finger formed on the upper end of the wall 18*c* and extending substantially horizontally in FIG. 10. The hook of the base plate portion 1010 is mounted on the finger of the wall 18*c* by engaging the same from the right to the left in FIG. 10. The base plate portion 1010 is thus held on the wall 18*c* against the resiliency of the coil springs 31, with its inner end being flexible vertically under certain resiliency.

The swing plate portion 1020 is joined to the inner end of the base plate portion 1010 through a thinner grooved portion 1030, so that the swing plate portion 1020 can swing as a whole about the thinner portion 1030. The swing plate portion 1020 is of a bent configuration which extends a certain distance obliquely downwardly from the base plate portion 1010 and then substantially vertically downwardly. The vertically downwardly extending portion of the swing plate portion 1020 contacts the rear end of the case 21 of the image developing device 17. The lowermost end of the vertically downwardly extending portion of the swing plate portion 1020 is positioned by abutting engagement with a rib stopper on the image forming unit case 18.

The vertically downwardly extending portion of the swing plate portion 1020 has a spring seat 1040 projecting toward the wall 18*c* of the case 18. One end of the coil spring 31 is fitted over the spring seat 1040. The other end of the coil spring 31 is mounted in a cavity formed in the wall 18*c*. The image developing device 17 is thus resiliently pressed to the left in FIG. 10 by each coil spring 31 through the swing plate portion 1020, so that the developing roller 22 of the image developing device 17 is pressed against the peripheral surface of the photosensitive drum 4. The two coil springs 31 are symmetrically positioned in the longitudinal direction of the developing roller 22 to urge the latter in equilibrium in the longitudinal direction. Therefore, the developing roller 22 is held against the photosensitive drum 4 under uniform pressure.

Figure 27:
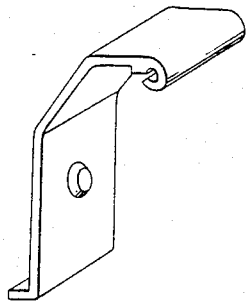
FIG. 27 is a perspective view of a presser according to another embodiment of the present invention.

FIG. 27 shows a hinged presser according to another embodiment of the invention. The hinged presser of an integrally formed structure has no swing plate portion and includes a hinge for attachment to the image forming case unit 18. Therefore, the hinged presser can swing as a whole about the hinge.

The spring-loaded structure as described above can be employed when both of the developing roller 22 and the photosensitive drum 4 have rigid surfaces. Where at least one of the developing roller 22 and the photosensitive drum 4 is made of a resilient material, this resilient material can appropriately be elastically deformed by the spring-loaded structure to keep the developing roller 22 and the photosensitive drum 4 in contact with each other over an area suitable for image development. Even when the photosensitive drum 4 or the developing roller 22 vibrates slightly while the laser printer is in operation, they are held in resiliently pressed engagement with each other by the coil springs 31, 32. The area in which the photosensitive drum 4 or the developing roller 22 contact each other is therefore not varied to a large extent, so that images of high quality can be produced.

In an image developing device wherein the developing roller 22 and the photosensitive drum 4 are spaced with a certain gap therebetween, the developing roller 22 can be urged toward the photosensitive drum 4 under the resiliency of the coil springs 31 to hold the shaft 22*a* of the developing roller 22 against stoppers for thereby positioning the developing roller 22 and the photosensitive drum 4 accurately relatively to each other.

Other biasing means than the coil springs 31 may be employed, and the pressing forces from such biasing means may be transmitted through the second stopper 80 to the image developing device 17. The biasing means may be supported on the image developing device 17.

Printing operation is carried out after the image carrier unit 16 and the image developing device 17 have been accommodated in the image forming unit case 18 and then the upper housing portion 10*a* has been closed, as shown in FIG. 9. If, at this time, the image carrier unit 16 and the image developing device 17 were moved vertically or vibrated with respect to the image forming unit case 18 under external forces applied, the quality of an image formed on a sheet of image recording paper would be lowered. With the illustrated arrangement, however, the image carrier unit 16 and the image developing device 17 are vertically held in place resiliently and stably within the case 18 against unwanted displacement or vibration with respect to the case 18.

Where the developing roller 22 rotates counterclockwise at a peripheral speed higher than that of the photosensitive drum 4 which rotates clockwise, as in the illustrated laser printer, the developing roller 22 is subject to strong external forces applied obliquely upwardly in the direction of the arrow E in FIG. 10 from the photosensitive drum 4. However, the image developing device 17 is prevented from being lifted by the external forces applied in the direction of the arrow E since the image developing device 17 is held down by the downward forces of the coil springs 32.

When the upper housing portion 10*a* is opened as shown in FIG. 12, the coil springs 32 are released, allowing the image developing device 17 to be easily removed from the image forming unit case 18. When the upper housing portion 10*a* is closed again, the image developing device 18 can be locked in position by the coil springs 32 against vertical movement. The image developing device 17 can thus be locked and unlocked quite easily simply by opening and closing the upper housing portion 10*a* without requiring any special operation on the part of the operator.

Positioning and holding of the image forming unit case 18 will be described below.

Figure 13:
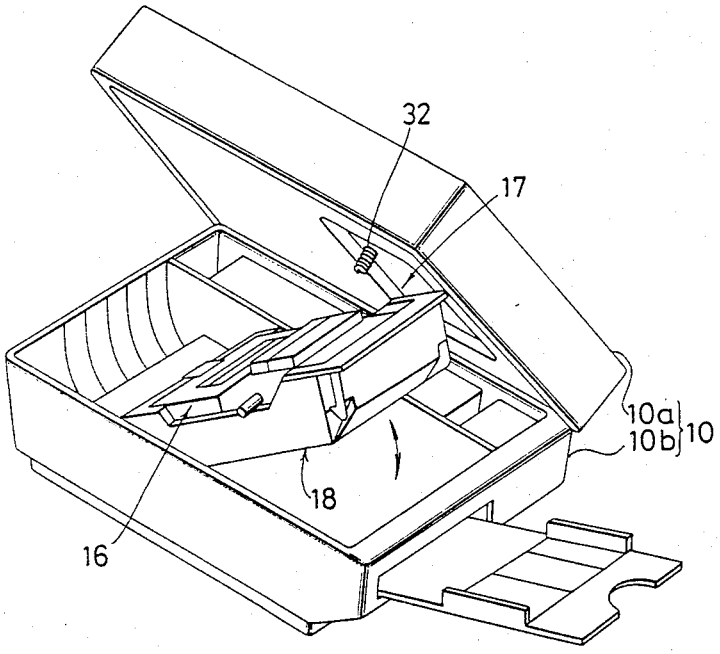

As illustrated in FIGS. 9 through 11, the lefthand wall of the image forming unit case 18 has a pair of spaced pins 110, 111 projecting laterally and fitted respectively in support grooves 113, 114 defined in side plates 112*a*, 112*b* of a frame 112 of the lower housing portion 10*b*. Therefore, the image forming unit case 18 with the image carrier unit 16 and the image developing device 17 accommodated therein can be angularly lifted about the pins 110, 111 when the upper housing portion 10*a* is opened, as shown in FIG. 13. Inasmuch as the sheet 2 of image recording paper passes through a feed path below the image forming unit case 18, the feed path can be exposed by thus turning the case 18 upwardly to remove a jammed sheet W from the feed path. The image forming unit case 18 can also be detached from the lower housing portion 10*b*.

When the image forming unit case 18 is mounted in position as shown in FIGS. 9 and 10, the case 18 is required to be positioned correctly with respect to the lower housing portion 10*b*, especially its frame 112. The image forming unit case 18 can be positioned by a locking device 115 with respect to the frame 112. More specifically, the locking device 115 has an elongate rocking member 117 angularly movably supported on a pair of support pins 116 projecting from the image forming unit case 18. The rocking member 117 has on its opposite ends a pair of locking fingers 118 and a knob 119 integrally formed with a central portion thereof. The rocking member 117 also has a horizontally bent spring seat 121. A compression coil spring 123 is placed under compression between the spring seat 121 and a horizontally bent portion 122 of the image forming unit case 18. The rocking member 117 is normally urged by the compression coil spring 123 to turn clockwise in FIG. 10 about the axis of the support pins 116. The lower housing frame 112 has a pair of engagement holes 124 defined respectively in side plates 112*a*, 112*b*, respectively. When the image forming unit case 18 is mounted in place as shown in FIG. 10, the locking fingers 118 are caused to engage in the engagement holes 124, respectively, under the forces of the coil spring 123. Another compression coil spring 125 which projects downwardly is disposed in the case 18 and has a lower end pressed against a lever 126 on the lower housing portion 10*b*. Therefore, when the image forming unit case 18 is mounted in position, it is urged to turn counterclockwise about the axis of the pins 110, 111 under the bias of the compression coil spring 125. Therefore, the locking fingers 118 are held against upper wall surfaces of the engagement holes 124 to lock the image forming unit case 18 in the mounted position. The locking fingers 118 may be disposed on the lower housing portion 10*b*, and the engagement holes 124 engaged by the locking fingers 118 may be defined in the image forming unit case 18.

For opening the image forming unit case 18, the knob 119 of the rocking member 117 is pulled upwardly in FIG. 10. The rocking member 117 is turned counterclockwise about the axis of the support pins 116 to displace the locking fingers 118 out of the engagement holes 124, thus unlocking the case 18, which can now be opened to the position of FIG. 13 through angular movement about the pins 110, 111. When the image forming unit case 18 is to be returned to the position of FIG. 10, it is turned back into the lower housing portion 10*b*, whereupon the locking fingers 118 are automatically caused to engage in the engagement holes 124 to lock the image forming unit case 18. Therefore, the image forming unit case 18 can be held in position through the aforesaid simple operation. Since pins 110, 111 of the image forming unit case 18 are fitted in the support grooves 113, 114, respectively, of the lower housing frame 112, the image forming unit case 18 can be properly positioned with respect to the lower housing portion 10*b* at the same time that the case 18 is held in the lower housing portion 10*b*.

Instead of angularly movably supporting the rocking member 117 of the locking device 115, the locking fingers 118 may be arranged to be elastically deformable for locking and unlocking the case 18.

As described above, the image forming unit case 18 is positioned by the locking device 115 with reference to the angularly movably supported end thereof. When forces produced upon rotation of the photosensitive drum 4 are applied to the image forming unit case 18, the pins 110, 110 about which the case 18 is angularly movable tend to be displaced slightly or wobble with respect to the support grooves 113, 114. When this happens, the image forming unit case 18 may be inaccurately positioned, and an image on the sheet 2 may be lowered in image quality. To avoid this problem, it is preferable to hold a portion of the case 18 where the shaft of the photosensitive drum 4 is supported, or an adjacent portion in engagement with the lower housing frame 112 for increasing the accuracy with which the case 18 is positioned with respect to the case 18. In the embodiment shown in FIG. 11, the side plate 18*a* of the case 18 has a positioning recess 128 near the support recess 27, and the side plate 18*b* has a positioning recess 127 at the support recess 27. A support plate 112*c* is fixedly joined to the side plate 112*b* of the lower housing frame 112, and a reference pin 130 projects laterally from the support plate 112*c*. Another reference pin 131 projects laterally from the side plate 112*a* of the lower housing frame 112. When the image forming unit case 18 is mounted in position, the reference pins 130, 131 engage respectively in the positioning recesses 127, 128, respectively, for increased positioning accuracy for the image forming unit case 18. The positioning recesses 127, 128 open downwardly to allow smooth entry of the reference pins 130, 131 into the positioning recesses 127, 128, respectively, when the image forming unit case 18 is angularly moved into the lower housing frame 112. By positioning the image forming unit case 18 near the photosensitive drum 4, the case 18 is prevented from being displaced or wobbling when the photosensitive drum 4 is rotated.

In FIG. 11, the reference pin 130 is constituted by the shaft of gears 132 for driving the gears of the developing roller 22 and the photosensitive drum 4 through other gears. Therefore, the positioning structure is simplified.

As described above, the sheet 2 of image recording paper is properly timed by the resist roller pair 3 before being fed to the photosensitive drum 4. As shown in FIG. 10, the resist roller pair 3 comprises a driver roller **3*a* and a driven roller 3*b* held in rolling contact therewith. The driver roller 3*a* is rotatably, but immovably supported by the side plates 112*a*, 112*b*, whereas the driven roller 3*b* is rotatably supported on the lever 126 which has one end angularly movably supported on the side plate 112 by a pin 135. When the image forming unit case 18 is held in position as shown in FIG. 10, the spring 125 on the case 18 presses the lever 126, which urges the driven roller 3*b* to be pressed against the driver roller 3*a* for feeding the sheet 2 toward the photosensitive drum 4. When the image forming unit case 18 is opened as shown in FIG. 13, the lever 126 is released from the depressing forces from the spring 125. Therefore, the lever 126 can manually be turned easily about the pin 135 for removing a sheet 2 of image recording paper jammed between the rollers 3*a*, 3*b*. Other sheet feed rollers than the resist rollers may be pressed against and released from each other by the image forming unit case 18**.

The sheet 2 passes below the image forming unit case 18. In the illustrated embodiment, a lower portion of the rocking member 117 of the locking device 115 is utilized as a guide for the sheet 2. With such an arrangement, it is not necessary to provide an independent guide member on the righthand side of the image forming unit case 18, resulting in a reduced number of parts. Furthermore, when the image forming unit case 18 is angularly lifted, a jammed sheet can immediately be removed from below the case 18. The sheet 2 is also guided in its feed path by a plurality of ribs 136 arrayed in a direction normal to the sheet of FIG. 10.

By pressing and releasing the resist roller pair 3 through the movement of the image forming unit case 18 and also by guiding the sheet 2 below the image forming unit case 18, the functional capability of the image forming unit case 18 is expanded, and at the same time the number of components required is reduced.

The principles of the present invention are applicable to other various image forming apparatus than the laser printer, such as a copying machine, a facsimile receiver/transmitter, or the like.

Although certain preferred embodiments have been shown and described, it should be understood that many changes and modifications may be made therein without departing from the scope of the appended claims.

What is claimed is:

1. An image developing device comprising:

a developing roller for supplying a thin layer of one-component toner to a latent image carrier;

a toner supply roller independently rotatable in abutting engagement and in pressure contact with said developing roller, said toner supply roller being electrically conductive;

said toner being triboelectrically charged by said toner supply roller; and bias voltage distributing means for applying a voltage VB to said developing roller and a voltage VR to said toner supply roller, where both voltages are of the same polarity, VB being less than VR when the toner is positively chargeable, and VB being greater than VR when the toner is negatively chargeable.

2. An image developing device according to claim 1, wherein said latent image carrier comprises a photosensitive drum.

3. An image developing device according to claim 1, further including a toner hopper for containing the toner therein and supplying the toner to said toner supply roller, and an agitator disposed in said hopper for agitating the toner therein.

4. An image developing device according to claim 1, further including an eraser brush held against a peripheral surface of said developing roller for removing electric charges from residual toner on the developing roller, and a member held against a peripheral surface of said developing roller for regulating the thickness of the toner layer on the developing roller.

5. An image developing device according to claim 1, wherein said developing roller comprises a cylindrical core member, a magnetic rubber layer disposed around said core member said magnetic rubber layer being magnetized alternately by N and S poles, and a plurality of floating electrodes bonded by an adhesive layer to an outer circumferential surface of said magnetic rubber layer and arranged in a stripe pattern.

6. An image developing device according to claim 5, wherein each of said floating electrodes is made of copper particles or epoxy resin with carbon particles dispersed therein.

7. An image developing device according to claim 1, wherein said electrically conductive resilient material is a resilient material in which electrically conductive carbon is impregnated or dispersed.

8. An image developing device according to claim 1, further including a power supply connected between said developing roller and said toner supply roller for applying bias voltages to said developing roller and said toner supply roller said power supply having at least two switchable states where the state is switched as a function of whether the toner is positively or negatively chargeable.

9. An image developing device according to claim 1 wherein said toner supply roller and said developing roller rotate in the same direction and the peripheral surfaces of the developing roller and toner supply roller move opposite to each other at the point where they contact.

10. An image developing device according to claim 1, further comprising a doctor blade for regulating the thickness of the toner layer on said developing roller, said doctor blade being in contact with the developing roller at a position between the contact point with the toner supply roller and the contact point with the latent image carrier.

11. An image developing device according to claim 1, further comprising a doctor blade for regulating the thickness of the toner layer on said developing roller, said doctor blade being in contact with the developing roller at a position between the contact point with the toner supply roller and the contact point with the latent image carrier, wherein said toner supply roller and said developing roller rotate in the same direction and the peripheral surfaces of the developing roller and toner supply roller move opposite to each other at the point where they contact.

12. An image developing device according to claim 1, further comprising:

a housing comprising a lower housing portion and an upper housing portion, said upper housing portion being openable from said lower housing portion;

an image carrier unit including a photosensitive member, said image carrier unit being attachable to and detachable from said lower housing portion;

a developing unit including a developing roller and a toner supply roller, said developing unit being attachable to and detachable from said lower housing portion; and said bias voltage distributing means including a main input terminal provided in said housing for applying full bias voltage to one end of a shaft of one of said developing roller and said toner supply roller, and a bias voltage distributing means provided in said developing unit electrically connected to the other end of said shaft for distributing said full bias voltage to said roller.

13. An image developing device according to claim 12, wherein said bias voltage distributing means comprises a supply bias terminal electrically coupled to an end of a shaft of said toner supply roller, a circuit electrically connected to said supply bias terminal, and a developing bias terminal electrically connecting said circuit to an end of a shaft of said developing roller.

14. An image developing device according to claim 13, wherein each of said first and second resistors comprises a thick-film resistor.

15. An image developing device according to claim 13, wherein said circuit is mounted on an insulating baseboard, and includes a first resistor connected between said supply bias terminal and said developing bias terminal, and a second resistor connecting said developing bias terminal to ground, when the toner is positively chargeable.

16. An image developing device according to claim 1, wherein said bias voltage distributing means has at least a first state where $VB<VR$ and a second state where $VB>VR$, said bias voltage distributing means being switched between said states as a function of the toner being positively or negatively chargeable.

* * * * *